United States Patent [19]

Seibold, Jr.

[11] 4,193,152

[45] Mar. 18, 1980

[54] CLOSEABLE PILLOW, TOTE BAG AND THE LIKE

[76] Inventor: Charles R. Seibold, Jr., 202 Post & Rail Rd., Longwood, Fla. 32750

[21] Appl. No.: 882,414

[22] Filed: Mar. 1, 1978

[51] Int. Cl.[2] ..... A47G 9/00; A61G 7/06

[52] U.S. Cl. ..... 5/490; 5/434; 150/3

[58] Field of Search ..... 150/3; 229/62; 5/434–437, 474, 490, 338, 341, 344

[56] References Cited

U.S. PATENT DOCUMENTS

| | | | |
|---|---|---|---|
| 2,545,970 | 3/1951 | Rand | 5/339 |
| 2,779,033 | 1/1957 | Fountain | 5/339 |
| 3,036,616 | 5/1962 | Allen | 150/3 |
| 3,319,273 | 5/1967 | Solin | 5/344 |
| 3,879,775 | 4/1975 | Iwato | 150/3 |

*Primary Examiner*—Casmir A. Nunberg

*Attorney, Agent, or Firm*—Harness, Dickey & Pierce

[57] ABSTRACT

A pillow is made from a strip of cloth or like material which is folded at the center to provide a pair of opposite sides which are stitched together at the side edges, the bottom edge requiring no stitching. A pair of strips of Velcro material extends across the open end and is stitched along the top and bottom edge of the strips to the open end of the two sides independently of each other and with the locking portion of the strips facing each other. The strips are approximately three-fourth inch in width and are of standard thickness and are applied to the underface of the ends and stitched in position before the side edges are stitched together.

7 Claims, 4 Drawing Figures

FIG. 1.
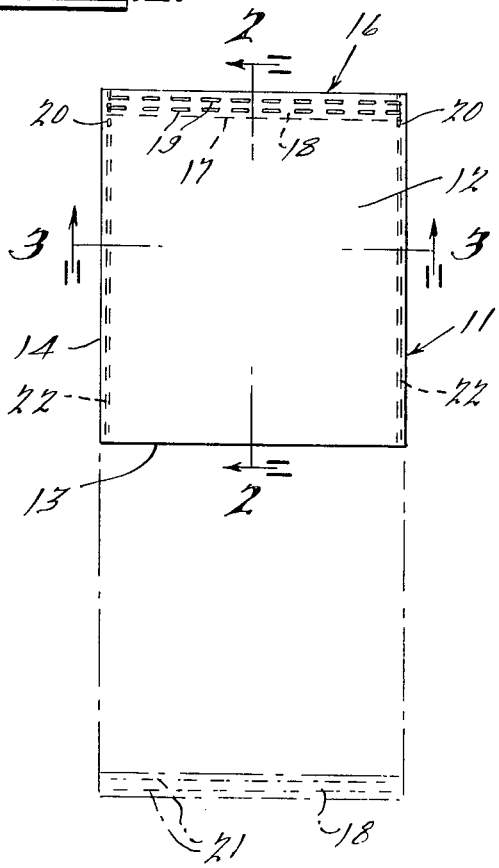
FIG. 2.
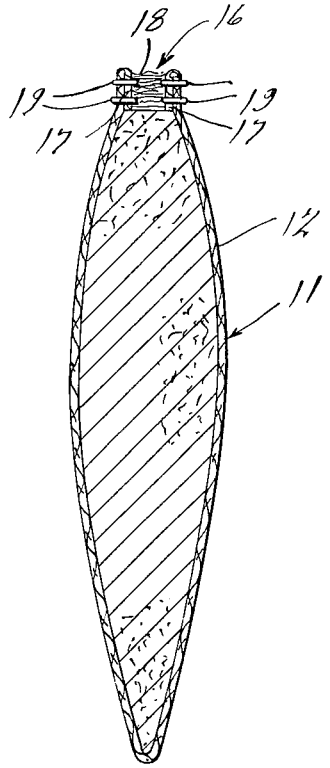
FIG. 3.
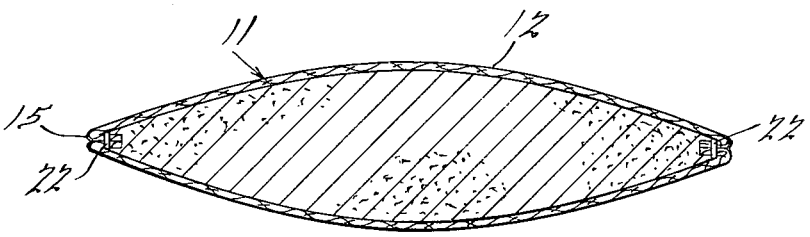
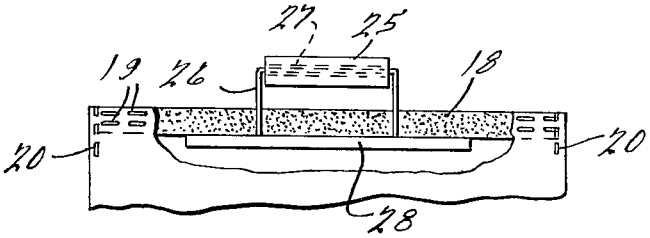
FIG. 4.

CLOSEABLE PILLOW, TOTE BAG AND THE LIKE

BACKGROUND OF THE INVENTION

Applicant had a preliminary investigation run to find whether such a pillow or casing had been employed heretofore in the art. The search uncovered U.S. Pat. No. 3,446,420 which disclosed a flexible container having a closure element of Velcro. Applicant found nothing in this patent which would anticipate the use of a pillow or casing having Velcro strips closing the open end throughout the width thereof with side stitching joining the ends of the facing strips. While other patents were disclosed in the search, none of them were pertinent to the structure which is disclosed and claimed.

SUMMARY OF THE INVENTION

The invention pertains to the construction of a casing in the nature of a pillow case made from a long piece of material which is folded at the center and stitched at the side edges. Two Velcro strips are first stitched to the folded material at the open end of the casing with the locking faces facing downwardly from the underside of the material. When the side edges are stitched, the stitching stops at the pair of Velcro strips since they do not face each other. The casing is then turned inside out to reverse the stitching and the strips which are in locked relation when stitched together at the ends. The casing or pillow can be used for many things. Sand can be placed in the casing if a pillow is to be employed on the beach or feathers may be employed if a pillow is to be used in a baby carriage, crib or the like. The end of the casing can be opened to remove material therefrom and permit it to be folded into a small unit or rolled about the Velcro strips at the open end.

BRIEF DESCRIPTION OF THE DRAWING

FIG. 1 is a plan view of a pillow or casing with the two side edges stitched and with the open end employing a pair of Velcro lockable strips;

FIG. 2 is a sectional view of the structure illustrated in FIG. 1, taken on the line 2—2 thereof;

FIG. 3 is an enlarged sectional view of the structure illustrated in FIG. 1, taken on the line 3—3 thereof, and FIG. 4 is a broken view of the open end of the casing with a carrying handle secured between the Velcro strips.

DESCRIPTION OF THE PREFERRED EMBODIMENT

The pillow or casing 11 is made from various types of material depending on the particular use for which the pillow or casing is intended. If the casing or pillow is to be stuffed with feathers and used for a baby carriage or the like, the material will be light, similar to a standard type of pillow casing. If, however, the casing is to be used to form a pillow on the beach, a much heavier material, even a light canvas could be employed to hold the sand which is sealed therein by the Velcro end strips at the open end. The piece of material 12 is of substantial length which is folded on its center along the line 13 with the side edges 14 in parallel relation. The side edges of the material overlap at 15, and at the open end 16 it is folded under at 17. A strip of Velcro or other locking material 18 is placed under the material 12 and is stitched at 19 along a top edge and also stitched at 21 along the bottom edge to firmly retain the strips 18 secured to the cloth.

The strips 18 may be of different form but the one which has been successfully employed is a Velcro strip having plastic hooks and loops which interengage each other when in faced relation and securely close the end opening 16 of the pillow or casing. After the side edges of the material 12 are stitched at 22 up to the Velcro strips, the casing is turned inside out to have the locking faces of the Velcro strips 18 facing each other. The stitching 22 is continued through the edges of the Velcro strips at 20 to prevent loss of material thereat. Thus, the stitching 20 and 22 extends through and beyond the engaged ends of the Velcro strip 18 for locking the ends and further strengthening the securement of the strips to the edge material at the open end. The material is not limited to cloth but may be a plastic material, oilcloth-like material and the like. An advertisement may be applied to one or both sides of the pillow or casing to disclose an article, company or the like. When using the pillow, the open end of the casing has the Velcro strips 18 pulled apart and filled with a desired material. The locking surfaces of the strips are cleaned and forced into locking engagement so as to completely close the open end of the casing or pillow. A handle 25 is shown in FIG. 4 having a fine wire 26 extended through a central aperture 27. The wire 26 extends down at the ends and is secured to a rod, channel element or the like 28. The wires are sealed by the Velcro strips which have the element 28 abutted therealong in carrying engagement therewith.

What is claimed:

1. In a casing, a length of cloth-like material, a pair of Velcro strips secured at each end of the material with the locking face disposed downwardly and with the material on the top thereof, folding the material in the center to have the Velcro strips on the top of each other with the locking faces disposed outwardly, securing the side edges of the material together up to the ends of the Velcro strips, turning the resulting casing inside out with the Velcro strips in position to lockingly engage each other to close the open end of the casing, and means for securing the side edges of the Velcro strips in sealed relation to each other and the side edges of the casing.

2. In a casing as recited in claim 1, wherein the securing of the Velcro strips and the side edges is done by stitching.

3. In a casing as recited in claim 1, wherein a pillow is made from the casing when filled with material and sealed by the Velcro strips at the open end.

4. In a casing as recited in claim 3, wherein a small package can be formed from the casing when the Velcro strips are separated and the contained material is removed.

5. In a casing as recited in claim 1, wherein a carrying handle has thin wire means extending downwardly therefrom, an elongated element to which the wire means is secured, the wire means being placed across the Velcro strips with the element supported therebelow when the two strips are secured together for closing the casing which is supported by the element so that it can be carried by the handle.

6. The combination with the casing having an open end, Velcro strips within said open end with the surface of the strips facing each other to lock the open end in closed position, an element disposed within said container adjacent to said Velcro strips, a handle, and wire means between said handle and element which extends between said Velcro strips when securing said container in closed position so as to suspend it on said element in carrying position.

7. The combination as recited in claim 6, wherein said handle and element are removable from said container when the Velcro strips are separated.

* * * * *